US010246943B2

(12) United States Patent
Bukach

(10) Patent No.: US 10,246,943 B2
(45) Date of Patent: Apr. 2, 2019

(54) DRILL BIT FOR DIRECTIONAL DRILLING AND METHOD OF MANUFACTURING

(71) Applicant: Astech Alloy Steel Technologies, Inc., Vassar, MI (US)

(72) Inventor: Alan R Bukach, Vassar, MI (US)

(73) Assignee: Astech Alloy Steel Technologies, Inc., Vassar, MI (US)

( * ) Notice: Subject to any disclaimer, the term of this patent is extended or adjusted under 35 U.S.C. 154(b) by 186 days.

(21) Appl. No.: 15/464,666

(22) Filed: Mar. 21, 2017

(65) Prior Publication Data

US 2017/0350189 A1 Dec. 7, 2017

Related U.S. Application Data

(60) Provisional application No. 62/346,875, filed on Jun. 7, 2016.

(51) Int. Cl.

| | |
|---|---|
| ***E21B 17/10*** | (2006.01) |
| ***E21B 7/00*** | (2006.01) |
| ***E21B 10/00*** | (2006.01) |
| ***E21B 7/04*** | (2006.01) |

(52) U.S. Cl.

CPC ..... *E21B 7/046* (2013.01); *E21B 10/003* (2013.01); *E21B 17/10* (2013.01); *E21B 7/00* (2013.01); *E21B 10/00* (2013.01)

(58) Field of Classification Search

CPC ..... E21B 7/046; E21B 10/46; E21B 10/565; E21B 7/064; E21B 17/10; E21B 17/1085; E21B 10/62

See application file for complete search history.

(56) References Cited

U.S. PATENT DOCUMENTS 1,577,810 A * 3/1926 Raymond ..... E21B 7/06 175/227
2,815,933 A * 12/1957 Dionisotti ..... E21B 10/40 175/391
5,899,283 A * 5/1999 Cox ..... E21B 7/06 175/376
5,941,322 A * 8/1999 Stephenson ..... E21B 7/06 175/376
6,161,636 A * 12/2000 Osborne ..... E21B 7/06 175/19

(Continued)

*Primary Examiner* — Shane Bomar
(74) *Attorney, Agent, or Firm* — Young Basile Hanlon & MacFarlane, P.C.

(57) ABSTRACT

A drill bit for directional drilling includes a main body and a wear component. The main body is unitary and formed of a first material. The main body includes opposed outer surfaces and a periphery extending between the opposed surfaces. The wear component is unitary and is formed of a second material that is harder than the first material. The wear component comprises a retention portion and a wear portion. The retention portion is positioned within the first material of the main body. The retention portion includes opposed retention surfaces that, moving in a direction inward from the periphery of the main body, taper apart from each other toward the opposed outer surfaces of the main body. The wear portion extends outward from the retention portion relative to the periphery of the main body. The wear portion is substantially planar and is configured to form an outer wear edge.

6 Claims, 11 Drawing Sheets

(56) References Cited

U.S. PATENT DOCUMENTS

| | | | | |
|---|---|---|---|---|
| 2003/0141114 | A1* | 7/2003 | Fuller | E21B 7/064 175/327 |
| 2003/0150652 | A1* | 8/2003 | Sved | E21B 7/064 175/398 |
| 2008/0011522 | A1* | 1/2008 | Hall | E21B 4/14 175/434 |
| 2012/0118640 | A1* | 5/2012 | Runquist | E21B 7/046 175/57 |
| 2014/0262535 | A1* | 9/2014 | Ford | E21B 7/064 175/327 |
| 2017/0030146 | A1* | 2/2017 | Propes | E21B 10/62 |

* cited by examiner

DRILL BIT FOR DIRECTIONAL DRILLING AND METHOD OF MANUFACTURING

CROSS-REFERENCE TO RELATED APPLICATION(S)

This application claims the benefit of U.S. Provisional Patent Application No. 62/346,875 filed Jun. 7, 2016, and hereby incorporates by reference the provisional application in its entirety.

TECHNICAL FIELD

The present disclosure is directed to directional drilling and, in particular, to drill bits for directional drilling, which have improved wear characteristics.

BACKGROUND

Directional drilling (e.g., horizontal directional drilling) involves drilling or boring through the earth, for example, to form a well or to run utilities through the ground. A directional drilling system typically includes a directional drilling machine (e.g., rig, drill, boring machine, etc.), multiple segments of drill pipe (e.g., step, rod, etc.), and a drill bit (e.g., cutting head or bit, drill bit). A proximal end of the drill pipe is coupled to and rotated by the directional drilling machine, while a distal end of the drill pipe is coupled to and rotates the drill bit. The drill bit can thereby drill a hole through the earth, which is increased in length as additional segments of drill pipe are added.

One type of drill bit is commonly referred to as a duckbill, which includes a base and a head. The base is configured to couple to the drill pipe. For example, the base is a generally planar segment having a predetermined hole pattern that corresponds to a bolt or hole pattern on the drill pipe. The predetermined pattern may, for example, be associated with a particular manufacturer of the directional drilling machine and/or drill pipe. The head is configured to direct the drill bit in a desired direction, while also engaging and drilling through the earth material. More particularly, the head extends from the base in a direction that is not parallel with the axis of the drill pipe (e.g., the head is portion of surface). This non-parallel angle allows the drill bit to be driven forward when not rotated, so as to steer the drill bit in the direction of the taper. The peripheral edges of the drill bit engage and move the earth material for drilling therethrough, but are subject to wear at varying rates depending on the earth material being drilled through.

SUMMARY

Disclosed herein is a drill bit for directional drilling. The drill bit includes a main body and a wear component. The main body is unitary and formed of a first material. The main body includes opposed outer surfaces and a periphery extending between the opposed surfaces. The wear component is unitary and is formed of a second material that is harder than the first material. The wear component comprises a retention portion and a wear portion. The retention portion is positioned within the first material of the main body. The retention portion includes opposed retention surfaces that, moving in a direction inward from the periphery, taper apart from each other toward the opposed outer surfaces of the main body. The wear portion extends outward from the retention portion relative to the periphery of the main body. The wear portion is substantially planar and is configured to form an outer wear edge.

The wear edge may be coextensive with the periphery of the main body or may protrude from the periphery of the main body. The retention portion may also include a plurality of retention segments that are spaced apart from each other, each of which includes the opposed retention surfaces. The wear component may further comprise a sacrificial portion that extends outward from the wear portion relative to the periphery of the main body. The sacrificial portion is coupled to the wear portion with a weakened portion therebetween. The sacrificial portion is configured to be removed from the wear component at the weakened portion to form the wear edge.

These and other aspects of the present disclosure are disclosed in the following detailed description of the embodiments, the appended claims and the accompanying figures.

BRIEF DESCRIPTION OF THE DRAWINGS

The present disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
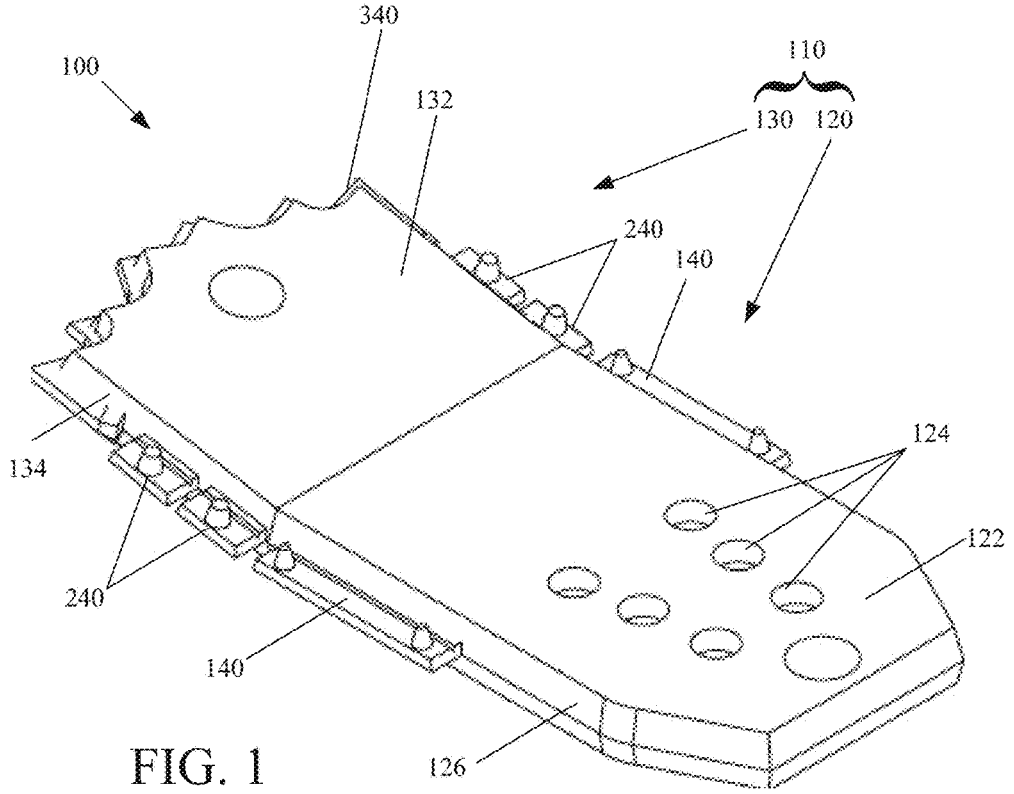
FIG. 1 is an upper, rear, right perspective view of a drill bit according to an exemplary embodiment.
Figure 1A:
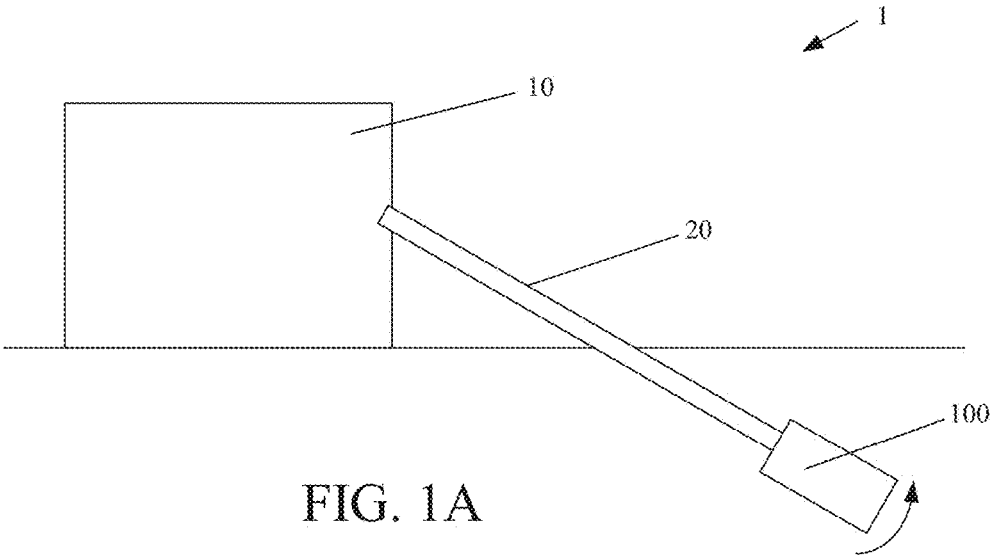
FIG. 1A is a schematic view of a directional drilling system.

As shown schematically in FIG. 1A, a directional drilling system 1 includes a directional drilling machine 10, drill pipe 20 coupled to and rotated by the drilling machine 10, and a drill bit 100 coupled and rotated by the drill pipe 20.

As shown in FIGS. 1-14, the drill bit 100 includes one or more wear components 140, 240, 340 (e.g., teeth, embedded components, etc.). By having embedded wear components 140, 240, 340 that engage and move the earth material, the drill bit 100 may have better wear and/or performance characteristics as compared to conventional drill bits.

Figure 2:
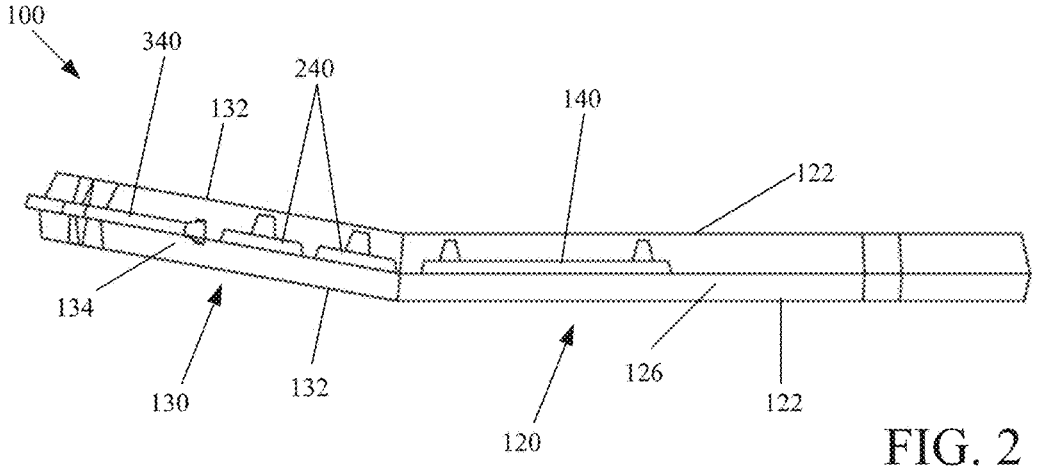
FIG. 2 is a side elevation view of the drill bit shown in FIG. 1.
Figure 3:
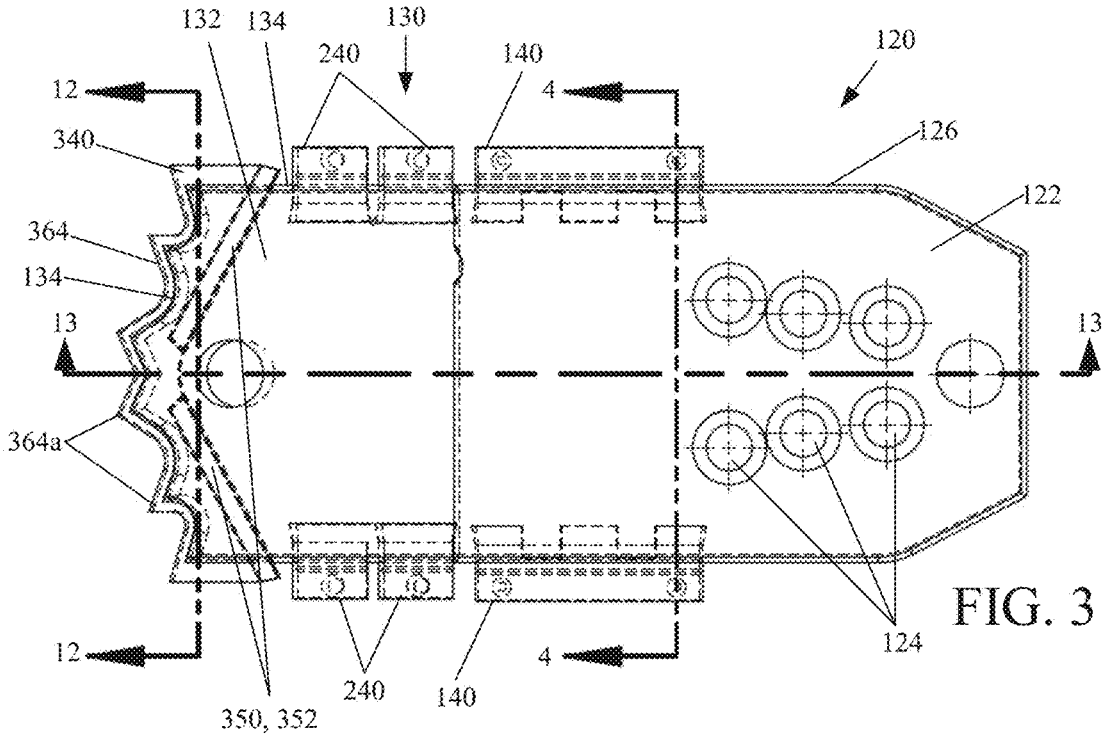
FIG. 3 is a top plan view of the drill bit shown in FIG. 1 with various hidden features shown in phantom lines (i.e., dashed lines).
Figure 4:
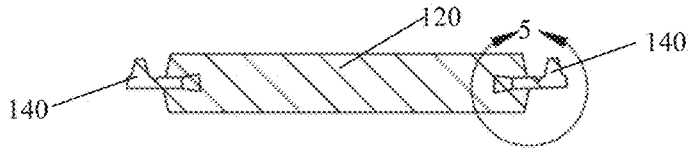
FIG. 4 is a cross-sectional view taken along line 4-4 in FIG. 3.
Figure 5:
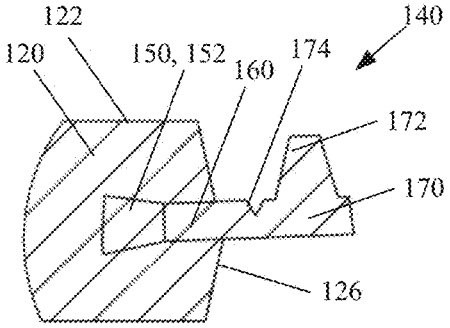
FIG. 5 is a detail view taken along line 5 in FIG. 4.

With reference to FIGS. 1-3, the drill bit 100 includes a main body 110 having a base 120 (e.g., base, coupling, rearward, or proximal segment or portion) and a head 130 (e.g., head, drilling, forward, or distal segment or portion). The base 120 is removably coupleable to a drill pipe (not shown). For example, the base 120 of the body 110 is a generally planar segment having planar, opposed surfaces 122 and a plurality of apertures 124 extending therethrough. One of the planar surfaces 122 (e.g., the upper surface, as shown in FIG. 1) is positioned proximate or adjacent a coupling portion of the drill pipe, while the apertures 124 are formed in a pattern that corresponds to a bolt or hole pattern of the drill pipe. The base 120 may include one or more wear components 140, which are embedded in the base 120 at various locations of a periphery 126 (e.g., peripheral surface or edge, or wear edge) of the base 120. For example, the wear components 140 may be positioned toward a distal end of the base 120 in a region adjacent the head 130.

The head 130 is configured to engage the earth material to both guide the drill bit 100 in a desired direction and to move or drill the earth material. The head 130 forms another generally planar segment having planar, opposed surfaces 132 with an outer periphery 134 (e.g., peripheral surface or edge, or wear edge) that extends between the opposed surfaces 132. The periphery 134 of the head 130 is continuous with the periphery 126 of the base 120, such that the main body 110 may be considered to have one periphery. The head 130 extends forward from the base 120 at a non-parallel angle relative thereto. For example, one or both of the opposed surfaces 132 of the head 130 may extend at an angle of approximately 5-20 degrees relative to the opposed surfaces 122 of the base 120. The head 130 also extends or tapers at a non-parallel angle relative to an axis of rotation of the drill tube, which allows the drill bit 100 to engage the earth material and be moved in a direction of the taper relative to the axis of the drill tube. The head 130 also includes one or more wear components 240, 340, which are embedded in the head 130 at various locations around the periphery of the head 130. For example, the wear components 240 may be positioned toward a proximal end of the head 130 in a region adjacent the base 120, while the wear component 340 may be position toward or at a distal end of the head 130 away from the base 120.

The main body 110 of the drill bit 100 is a unitary body, which is formed during a casting process. For example, the main body 110 may be a cast material, such as chromium-molybdenum alloy steel, iron, etc.

As referenced above, each of the wear components 140, 240, 340 is embedded in the main body 110 of the drill bit 100. More particularly, each of the different types of wear components 140, 240, 340 are cast-in-place components, meaning that the material forming the main body 110 solidifies around a portion of the wear components 140, 240, 340 for retention in the main body 110.

With reference to FIGS. 3-9, each of the wear components 140 generally includes a retention portion 150 (e.g., inner, coupling, or embedded portion or segment), a wear portion 160, and a sacrificial portion 170 (e.g., outer, mounting, or support portion or segment). The retention portion 150 includes one or more retention segments 152 that are embedded within the cast material of the main body 110, so as to couple and retain the wear component 140 to the main body 110 of the drill bit 100. The wear portion 160 extends outward from the retention portion 150 relative to the base 120 of the main body 110 of the drill bit 100, and is configured to engage the earth material. The sacrificial portion 170 extends further outward from the wear portion 160, and is configured to be retained in and supported by a mold to properly position and orient the wear component 140 during a casting process. Subsequent to the casting process, during which the cast material of the main body 110 solidifies around the retention portion 150, the sacrificial portion 170 is detached from the wear portion 160 proximate the outer periphery 126 of the base 120 of the main body 110. Accordingly, the drill bit 100 and the wear components 140 thereof may be considered to have two different states, which include a first state in which the sacrificial portion 170 remains attached the retention portion 150 and a second state in which the sacrificial portion 170 is detached from the retention portion 150.

The retention segments 152 are configured be positioned (e.g., embedded) within the cast material of the main body 110 of the drill bit 100, so as to couple and retain the wear component 140 to the main body 110 of the drill bit 100. As shown in FIGS. 3-9, the retention portion 150 includes one or more retention segments 152 (e.g., three), each of which widens (e.g., flares, tapers, etc.) in various directions while moving inward from the periphery 126 of the base 120 of the main body 110. In FIGS. 6-9, the periphery 126 of the head 120 of the drill bit 100 is shown in phantom lines for reference. As shown in FIGS. 4-5 and 8-9, each retention segment 152 widens or tapers toward the opposed surfaces 122 (e.g., in a vertical direction) of the base 120 of the drill bit 100. More particularly, opposed retention surfaces 152*a* (e.g., upper and lower surfaces) of the retention segment 152 extend straight at angle of approximately 3-20 degrees (e.g., approximately 10 degrees) or other suitable angle relative to each other. Over a majority of a length of each retention segment 152 (measured generally parallel to the periphery 126), the wear component 140 may, but for locating features of the sacrificial portion 170, have a generally constant cross-sectional shape in a plane that is generally perpendicular to an upper surface and an outer and/or inner edge of the wear component 140.

Figure 6:
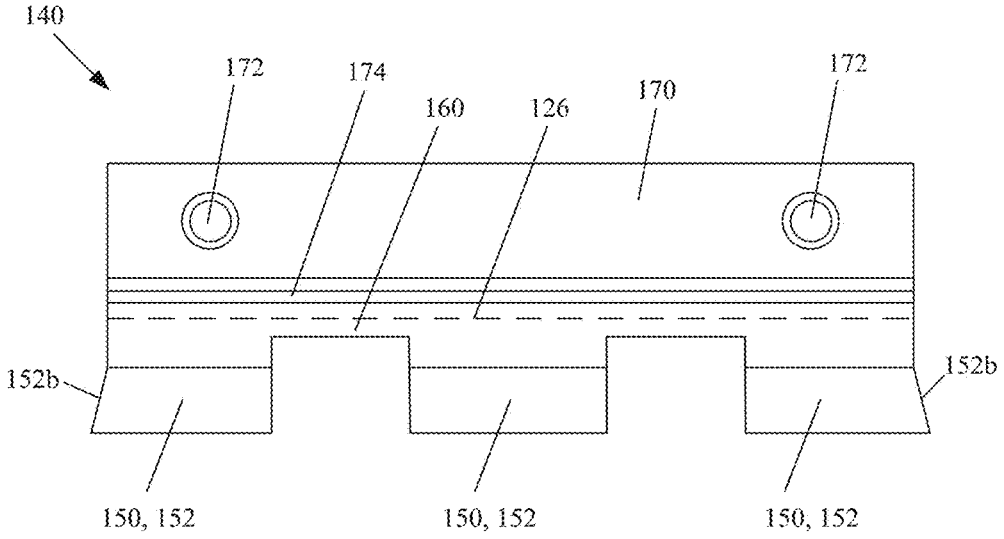
FIG. 6 is a top plan view of a wear component of the drill bit shown in FIG. 1, the wear component including a sacrificial portion.
Figure 7:
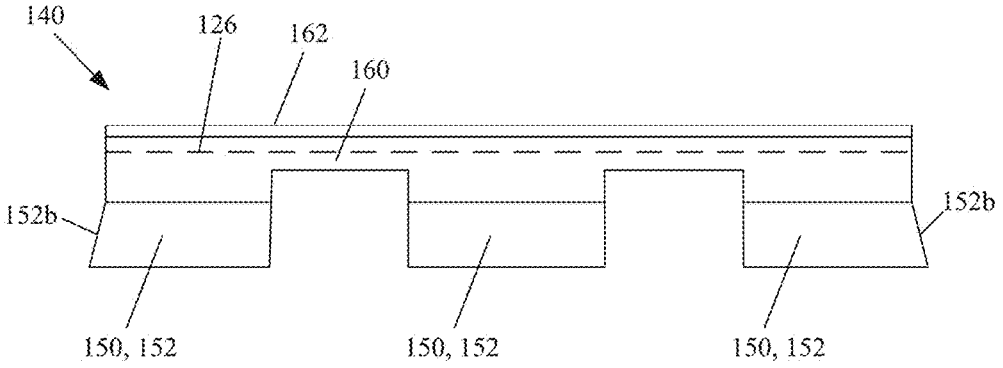
FIG. 7 is a top plan view of the wear component shown in FIG. 6 with the sacrificial portion removed.

Instead or additionally, as shown in FIGS. 3 and 6-7, the retention segment 152 widens or tapers in a direction generally following the opposed surfaces 122 of the base 120 of the main body 110 of the drill bit 100 (e.g., in a horizontal or lateral direction, or along the periphery 126 of the base 120). For example, opposed edges 152*b* (e.g., lateral edges or surfaces) of each retention segment 152 may extend straight at an angle of approximately 93-110 degrees (e.g., approximately 100 degrees) relative to an outer edge 162 of the wear portion 160 (discussed in further detail below).

In the example shown, the retention portion 150 may three retention segments 152, including two outer retention segments 152 and one middle retention segment. The outermost opposed edges 152*b* of the two outer retention segments flare or taper outwardly relative to each other. Inner opposed edges 152*b* of the two outer retention segments 152, as well both opposed edges 152*b* of the inner retention segment 152, may extend at a generally perpendicular angle relative to the edge 162 of the wear portion 160.

According to other embodiments, it is contemplated that the opposed surfaces 152*a* and opposed edges 152*b* of the retention segments 152 may widen in other manners (e.g., in a curved manner and/or at different angles). Furthermore, while the retention portion 150 is depicted as including three retention segments 152, the wear component 140 may be configured with fewer (e.g., one or two) or more (e.g., four or more retention) retention segments 152.

The wear portion 160 extends outward from the retention segments 152 relative to the base 120 of the drill bit 100. The wear portion 160 forms an outer edge 162 (e.g., outer or wear edge or surface) that protrudes outward from the periphery 126 of the base 120 (as shown) or is coextensive (e.g., flush) therewith. For example, the outer edge 162 of the wear portion 160 may extend generally parallel with the periphery 126 of the base 120. In use, the outer edge of the wear portion 160 engages the earth material for drilling or boring therethrough.

The wear portion 160 is substantially planar having opposed surfaces 164 (e.g., upper and lower surfaces) which are substantially planar and parallel with each other. The opposed surfaces 164 may, for example, protrude outwardly from the periphery 126 of the base 120 and be substantially parallel with one of the opposed surfaces 122 of the base 120, or be at an inclined angle relative thereto (see, e.g., wear component 140 in the drill bit 300 shown in FIGS. 15A-15E). According to other embodiments, the wear portion 160 may not be substantially planar, such as with the opposed surfaces 164 being planar but not parallel and/or being curved.

The wear portion 160 has a thickness that is less than that of the main body 110 of the drill bit 100. For example, the wear portion 160 may have a thickness of between approximately ⅛ and ¼ inch, while the main body 110 may have a thickness of between approximately ½ and 1 inch (e.g., approximately ¾ inch). The wear portion 160 also has a thickness that is less than that of the retention portion 150 at its thickest point at the peak of its tapered profile. According to other exemplary embodiments, the wear portion 160 may have a thickness that is approximately equal to that of the main body 110, such as approximately 75% or more (e.g., 90% or more) of the thickness of the main body 110. The wear portion 160 may also be thicker than the retention portion 150 at its peak thickness, for example, by forming a concave region between the retention portion 150 and the wear portion 160, thereby allowing the retention portion 150 to still taper toward the opposed surfaces 122 of the base 120 of the main body 110.

The wear portion 160 may be partially surrounded by the cast material of the base 120 of the main body 110 of the drill bit 100 and protrude outwardly therefrom. The wear portion 160 may also be coupled to and extend between multiple retention segments 152 at spaced apart locations generally along the outer periphery 126 of the base 120 of the drill bit 100. According to other embodiments, the wear portion 160 may have other shapes (e.g., curved) and/or be nonplanar (e.g., having a trapezoidal or curved cross-sectional profile in an inward/outward direction).

The sacrificial portion 170 is coupled to and extends outward from the wear portion 160 relative to the base 120 of the main body 110 of the drill bit 100. The sacrificial portion 170 is configured to be received in and supported by the mold during the casting process, so as to properly position and orient the wear component 140 relative to the main body 110 of the drill bit 100. The sacrificial portion 170 may, for example, be substantially rectilinear and planar and extend for a distance substantially equal to that of the wear portion 160 along the periphery 126 of the base 120. The sacrificial portion 170 may also include protrusions 172 that extend away from a planar face thereof. The protrusions 172 are positioning features that properly locate, orient, and retain the wear component 140 to the mold during the casting process.

Figure 8:
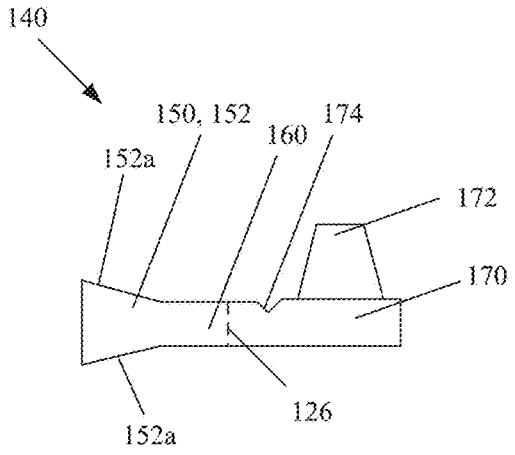
FIG. 8 is an end elevation view of the wear component shown in FIG. 6, the wear component including a sacrificial portion.
Figure 9:
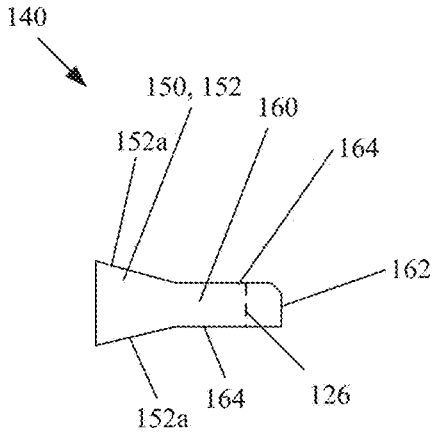
FIG. 9 is an end elevation view of the wear component shown in FIG. 6 with the sacrificial portion removed.

The sacrificial portion 170 is configured to be detached from the wear portion 160 after the casting process (see FIGS. 8-9). For example, the wear component 140 may include a weakened portion 174 (e.g., a groove having a V-shaped or curved cross-sectional shape) at which the sacrificial portion 170 may be broken from the wear portion 160. This forms the outer edge 162 of the wear portion 160, or the revealed edge may be ground or otherwise machined to form the final outer edge 162 (e.g., flush with the main body 110 of the drill bit 100). The weakened portion 174 may, for example, extend in a substantially straight line or other profile that corresponds to a desired profile of the outer edge 162. The sacrificial portion is removed, for example, by applying an impact (e.g., manually with a hammer), which causes the wear component 140 to fracture at the weakened portion 174 to separate the sacrificial portion 170 from the wear portion 160. Subsequently, the exposed wear portion 160 may be ground, for example, such that the outer edge 162 is flush with the periphery 126 of the base 120 of the main body 110. The sacrificial portion 170 may be removed in other manners, for example, by being cut or otherwise machined after the casting process.

The wear component 140, including the retention portion 150, the wear portion 160, and the sacrificial portion 170, is a unitary component that is harder and/or exhibits other improved wear characteristics as compared to the cast material forming the body 110 of the drill bit 100. For example, the wear component 140 may be formed (e.g., cast, forged, machined, and/or hardened) from a steel alloy (e.g., 15-3 chrome iron alloy) or other suitable material.

Figure 10:
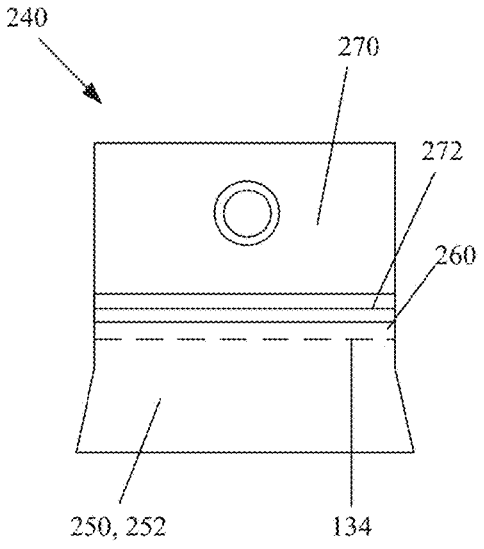
FIG. 10 is a top plan view of another wear component of the drill bit shown in FIG. 1, the wear component including a sacrificial portion.
Figure 11:
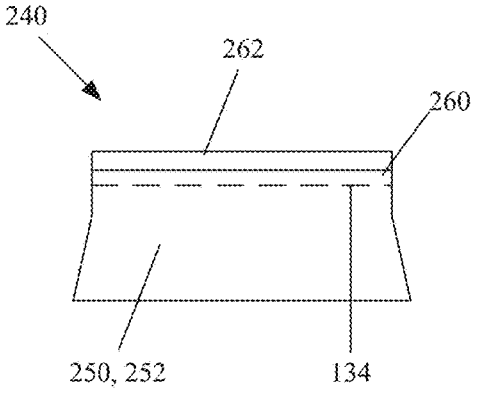
FIG. 11 is a top plan view of the wear component shown in FIG. 10 with the sacrificial portion removed.
Figure 12:
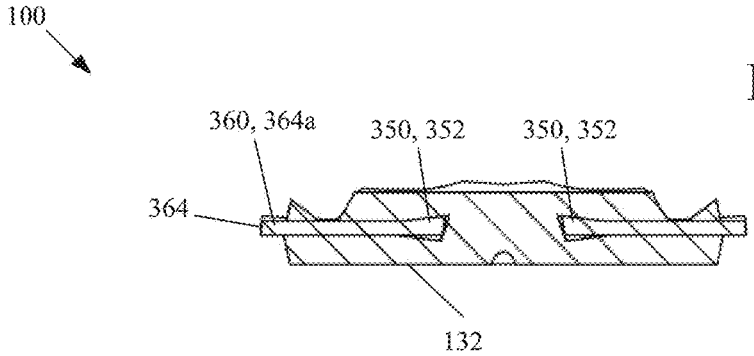
FIG. 12 is a cross-sectional view taken along line 12-12 in FIG. 3.
Figure 13:
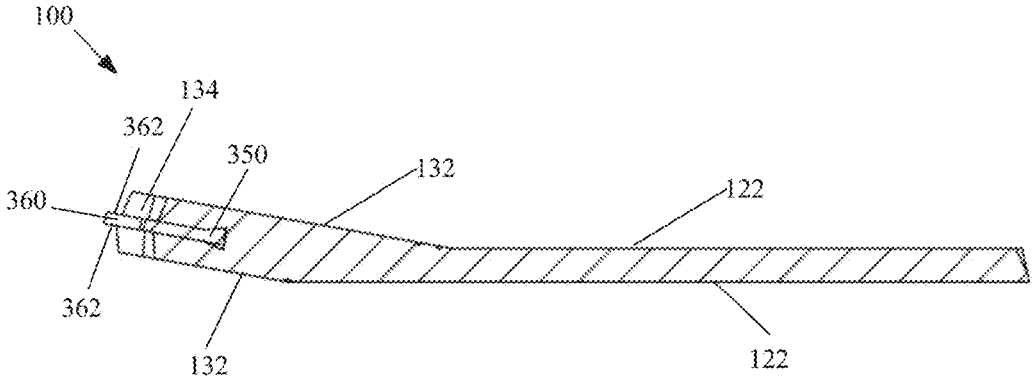
FIG. 13 is a cross-sectional view taken along line 13-13 in FIG. 3.

As shown in FIGS. 1-3 and 10-11, the drill bit 100 may additionally include one or more wear components 240. In FIGS. 10-11, the periphery 134 of the head 130 of the drill bit 100 is shown in phantom lines for reference. Each wear component 240 is configured similar to the wear component 140 by including a retention portion 250, a wear portion 260, and a sacrificial portion 270. However, the wear component 240 has a shorter overall length (measured along the periphery 134), and the retention portion 250 forms a single retention segment 252 having approximately the same length as the wear portion 260.

As with the retention portion 150, the retention portion 250 tapers or flares moving inward form the periphery 134 toward the opposed surfaces 132 of the head 130 and/or parallel with the opposed surfaces 132 (e.g., in a direction following the periphery 134). As with the wear portion 160, the wear portion 260 may be substantially planar and extends outward from the retention portion 250 to form a wear edge 262 beyond or coextensive with the periphery 134. As with the sacrificial portion 170, the sacrificial portion 270 extends outward form the wear portion 260 and is configured to detach therefrom at a weakened portion 272 to form the wear edge 262. The wear component 240 may, but for locating features of the sacrificial portion 270, have a substantially constant cross-section over a majority of the length thereof in a plane that is generally perpendicular to an upper surface and an inner and/or outer edge of the wear component 240. The wear components 240 may, for example, be coupled to the head 130 of the drill bit 100 proximate the periphery 134 thereof.

As with the wear component 140, the wear component 240, including its retention portion 250, wear portion 260, and sacrificial portion 270, is a unitary component that is harder and/or exhibits other improved wear characteristics as compared to the cast material forming the body 110 of the drill bit 100. For example, the wear component 240 may be formed (e.g., cast, forged, machined, hardened) from a steel alloy (e.g., containing chromium and/or molybdenum) or other suitable material. For further details of the wear component 240, including alternative configurations for various features or aspects thereof, refer to the discussion of the wear component 140 above.

As shown in FIGS. 1-3 and 12-14, the drill bit 100 may additionally include a wear component 340. The wear component 340 includes a retention portion 350 and a wear portion 360 extending outward therefrom relative to the head 130 of the main body 110 of the drill bit 100.

The retention portion 350 includes one or more retention segments 352, which are flared moving inward from the periphery 134 of the head 130 in a direction toward the opposed surfaces 132 of the head 130. While the wear portion 360 protrudes outwardly to form teeth 364*a*, as discussed below, the retention segments 352 each extend straight at a non-parallel angle relative to each other. The retention segments 352 may also protrude outwardly from the periphery 134 of the head 130 of the main body 110. As outer edges of the retention segments 352 are not surrounded by the cast material of the head 130, the angled relationship between the segments 352 aids in preventing side-to-side movement of the wear component 330 relative to the main body 110 of the drill bit 100.

Figure 14:
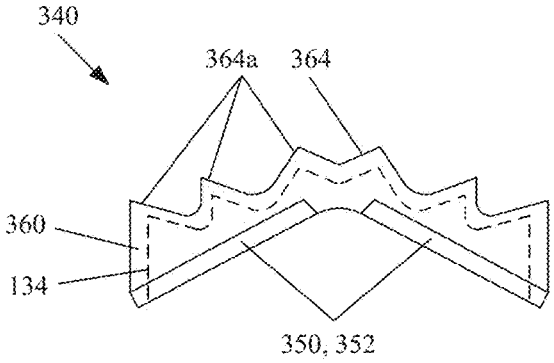
FIG. 14 is a top plan view of another wear component of the drill bit shown in FIG. 1.
Figure 15A:
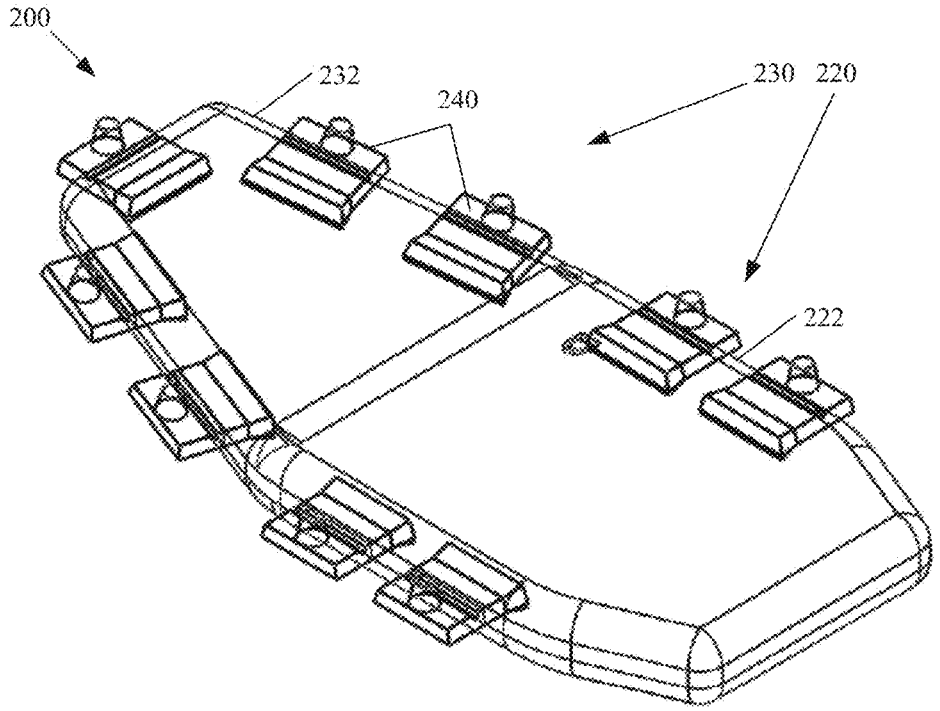
FIG. 15A is an upper, rear, right perspective view of a drill bit according to an alternative embodiment with various hidden portions shown in solid lines.
Figure 15B:
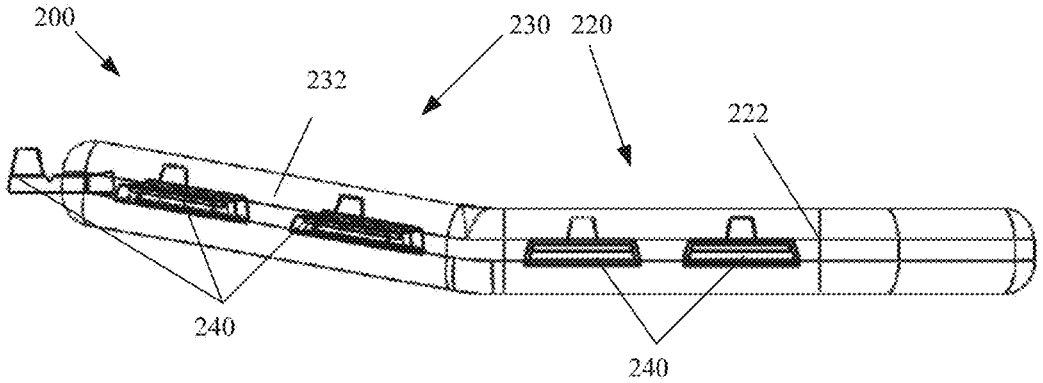
FIG. 15B is a side elevation view of the drill bit shown in FIG. 15A with various hidden portions shown in solid lines.
Figure 15C:
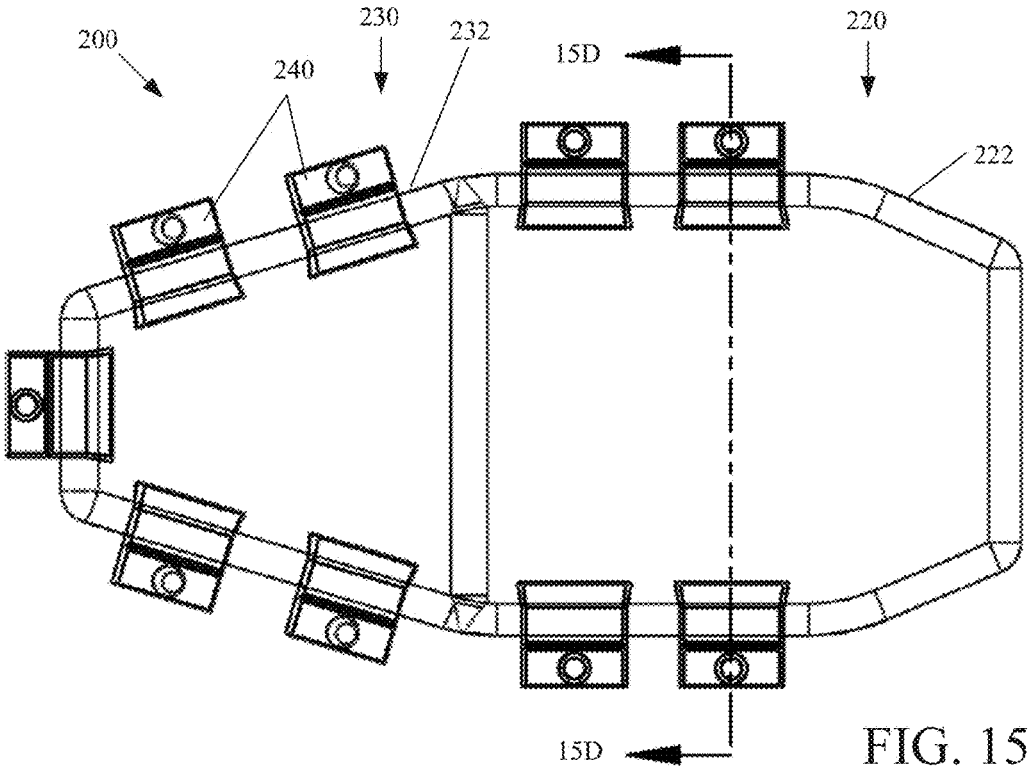
FIG. 15C is a top plan view of the drill bit shown in FIG. 15A with various hidden portions shown in solid lines.
Figure 15D:
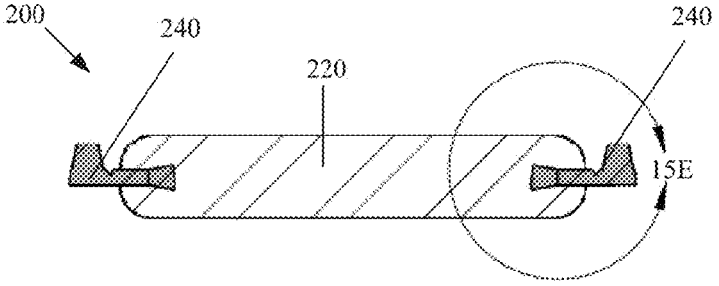
FIG. 15D is a cross-sectional view taken along line 15D-15D in FIG. 15C.
Figure 15E:
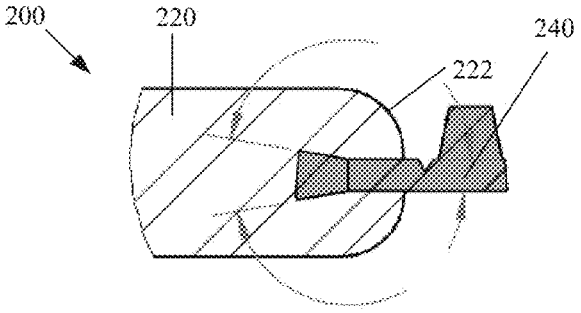
FIG. 15E is a detail view taken along line 15E in FIG. 15D.
Figure 16A:
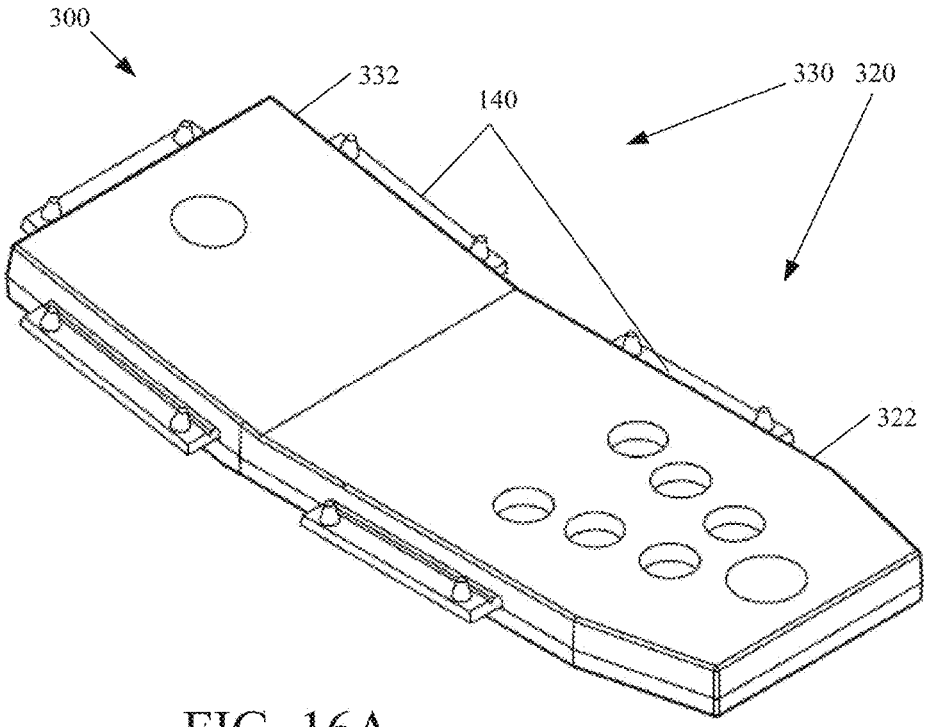
FIG. 16A is an upper, rear, right perspective view of a drill bit according to an alternative embodiment.
Figure 16B:
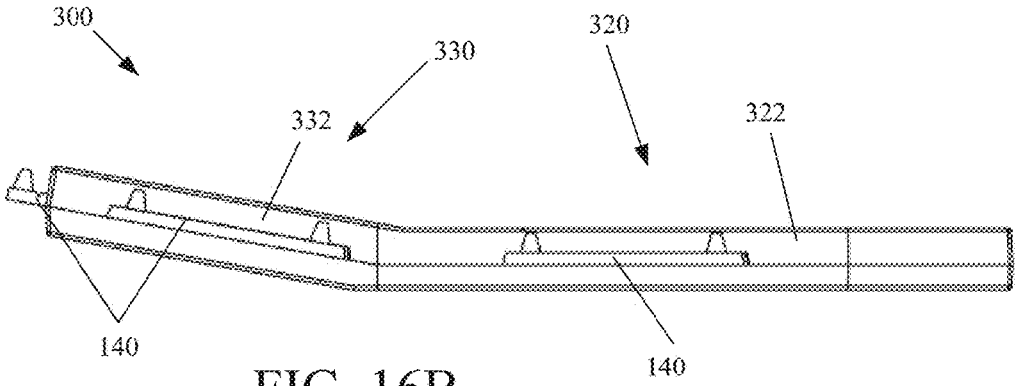
FIG. 16B is a side elevation view of the drill bit shown in FIG. 16A.
Figure 16C:
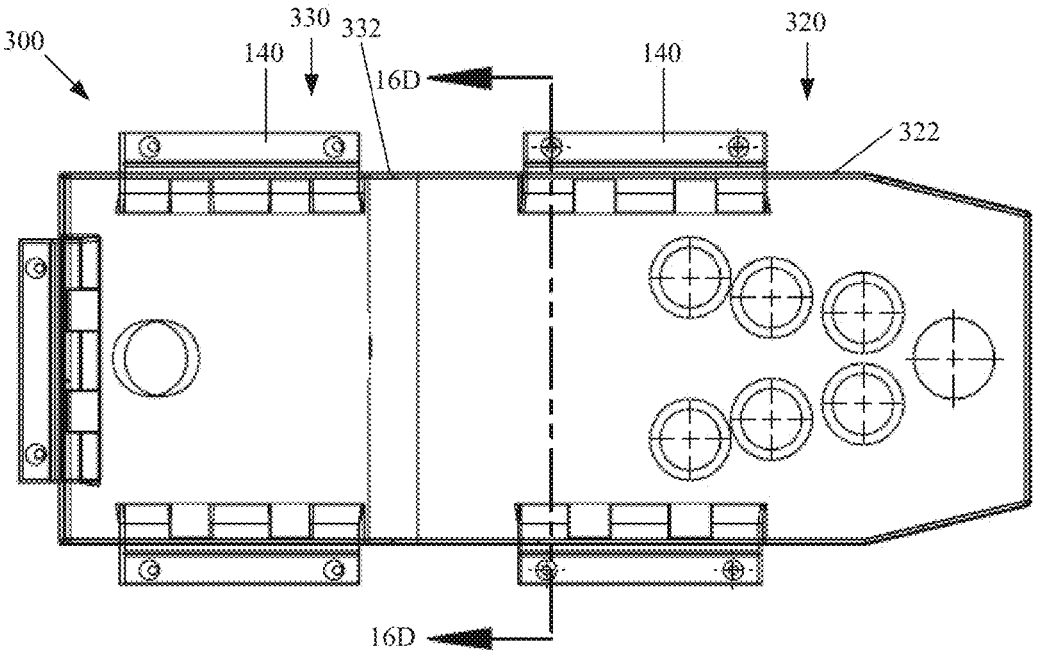
FIG. 16C is a top plan view of the drill bit shown in FIG. 16A with various hidden portions shown in solid lines.
Figure 16D:
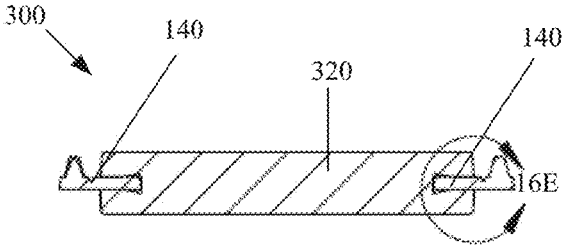
FIG. 16D is a cross-sectional view taken along line 16D-16D in FIG. 16C.
Figure 16E:
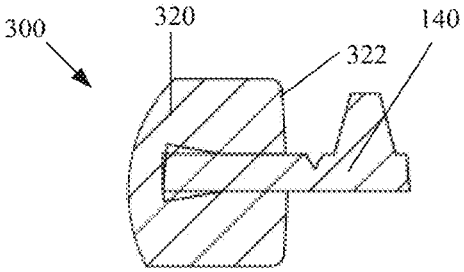
FIG. 16E is a detail view taken along line 16E in FIG. 16D.

The wear portion 360 extends outward from the retention portion 350. The wear portion 360 is substantially planar and includes opposed planar surfaces 362. An outer edge 364 of the wear portion 360 has a convoluted profile that forms a series of teeth 364*a* (e.g., jagged elements). The teeth 364*a* protrude outwardly from the retention portion 350 to form a distal end of the drill bit 100. The periphery 134 at a distal end of the head 130 may also have a convoluted profile that is complementary in shape to the teeth 364*a* of the wear component 350. In FIG. 14, the periphery 134 of the head is shown in phantom lines for reference.

During the casting process, the teeth 364*a* and/or retention segments 352 that protrude outwardly from the periphery 134 of the head 130 are engaged and supported by the mold.

As with the wear component 140, the wear component 340, including its retention portion 350 and wear portion 360, is a unitary component that is harder and/or exhibits other improved wear characteristics as compared to the cast material forming the body 110 of the drill bit 100. For example, the wear component 340 may be formed (e.g., cast, forged, machined, hardened) from a steel alloy (e.g., containing chromium and/or molybdenum) or other suitable material.

While the drill bit 100 has been described and depicted as having two wear components 140, four wear components 240, and one wear component 340, it should be understood that other drill bits may have more or fewer of any one of these wear components or modifications thereof, which are positioned at different locations of the main body 110 and/or in different orientations relative thereto.

For example, as shown in FIG. 15A-15E, a drill bit 200 may be configured similar to the drill bit 100 but includes only the wear components 240, which are spaced about peripheries 222, 232 of both the base 220 and the head 230 thereof. Similarly, as shown in FIGS. 16A-16E, a drill bit 300 may be configured similar to the drill bit 100 but includes only the wear components 140, which spaced about peripheries 322, 332 of both the base 320 and the head 330 thereof.

Figure 17:
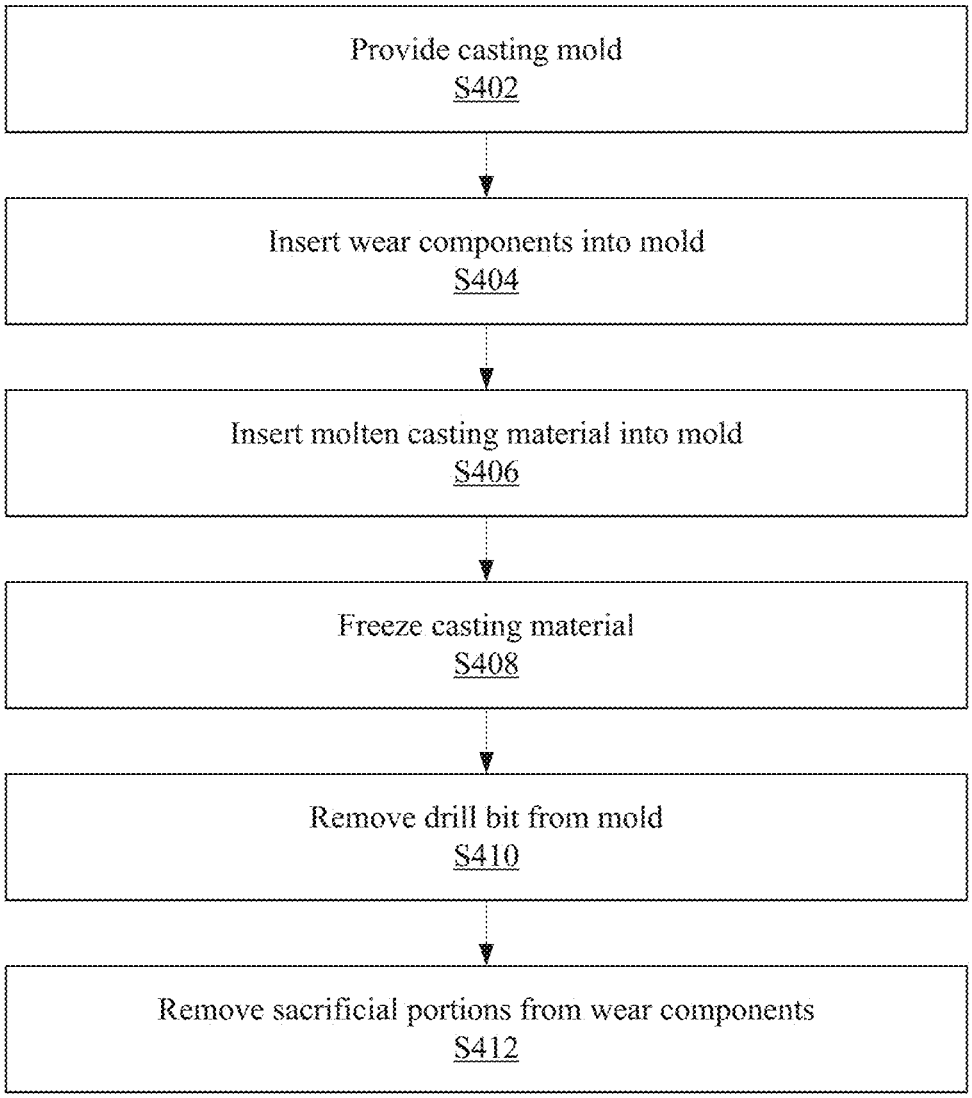
FIG. 17 is a flowchart of a method for manufacturing a drill bit.

Various methods are provided for manufacturing the drill bits 100, 200, 300 described above. While the method may vary depending on which of the wear components 140, 240, 340 are selected and their orientation relative to the main body 110 of the drill bits, each method generally involves the steps described herein and illustrated in FIG. 17.

In a first step S402 a mold is provided. The mold generally includes two halves (e.g., a cope and a drag), which cooperative define a void in a shape of the main body 110 of the drill bit 100. The mold may additionally include locating features (e.g., recesses) that correspond to the protrusions 172 of the wear components 140, 240, 340

In a second step S404, one or more of the wear components 140, 240, and/or 340 are inserted into the mold. As noted described above, the wear components 140, 240, 340 may be made from one of several manufacturing processes (e.g., casting, forging, machining, etc.) and of a material that is harder than the cast material forming the main body 110 of the drill bit 100, 200, or 300. When the wear components 140, 240, and/or 340 are inserted into the mold, the sacrificial portions 170 and/or 270 of the wear components 140 and/or 240, and/or the wear portion 360 of the wear component 340 are arranged between the upper and lower halves of the mold. Further, any protrusions 172 thereof are inserted into the corresponding locating feature, or are pressed into the material of the mold (e.g., sand) to be retained therein. The wear components 140, 240, and/or 340 are thereby held in proper position and orientation relative to the void of the mold. That is, the retention portions 150, 250, 350, which include the retention segments 152, 252, and/or 352 that are flared in the manners described above, extend into and are suspended within the void defined by the upper and lower halves of the mold.

In a third step S406, the cast material (e.g., chromium-molybdenum alloy steel, iron, etc.) is inserted in molten form into the mold in a manner that causes the molten material to flow around the retention portions 150, 250, and/or 350 of the wear components 140, 240, and/or 340, respectively.

In a fourth step S408, the cast material solidifies around the retention portions 150, 250, and/or 350 of the wear components 140, 240, and/or 340.

In fifth step S410, the drill bit 100, 200, or 300 is removed from the mold, or the mold material is removed from the drill bit 100.

In a sixth step S412, the sacrificial portion 170 and/or 270 are removed from each the wear components 140 and/or 240, respectively, and discarded. By removing the sacrificial portion 170 and/or 270, the wear edges 162 and/or 262 are formed on the wear portions 160 and/or 260, respectively, of the wear components 140 and/or 240.

While the present disclosure has been described in connection with certain embodiments, it is to be understood that the present disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A drill bit for directional drilling comprising:

a main body that is unitary and formed of a first material, the main body having opposed outer surfaces and a periphery extending between the opposed surfaces;

a wear component that is unitary and formed of a second material that is harder than the first material, wherein the wear component comprises:

a retention portion positioned within the first material of the main body and having opposed retention surfaces that, moving inward from the periphery of the main body, taper apart from each other toward the opposed outer surfaces of the main body, and a wear portion extending outward from the retention portion relative to the periphery of the main body, the wear portion being substantially planar and being configured to form an outer wear edge; and wherein the main body comprises axially arranged planar head and base portions the planes of which are non-parallel.

2. The drill bit as defined in claim 1 wherein the angle between the planar portions of the main body is between 5 and 20 degrees.

3. A drill bit for directional drilling comprising:

a main body that is unitary and formed of a first material, the main body having opposed outer surfaces and a periphery extending between the opposed surfaces;

a wear component that is unitary and formed of a second material that is harder than the first material, wherein the wear component comprises:

a retention portion positioned within the first material of the main body and having opposed retention surfaces that, moving inward from the periphery of the main body, taper apart from each other toward the opposed outer surfaces of the main body, and a wear portion extending outward from the retention portion relative to the periphery of the main body, the wear portion being substantially planar and being configured to form an outer wear edge; and wherein the retention portion includes a plurality of retention segments that are spaced apart from each other, each retention segment having the opposed retention surfaces.

4. The drill bit according to claim 3, wherein the wear edge is coextensive with the periphery of the main body.

5. The drill bit according to claim 3, wherein the wear portion protrudes from the periphery of the main body.

6. A drill bit for directional drilling comprising:

a main body that is unitary and formed of a first material, the main body having opposed outer surfaces and a periphery extending between the opposed surfaces;

a wear component that is unitary and formed of a second material that is harder than the first material, wherein the wear component comprises:

a retention portion positioned within the first material of the main body and having opposed retention surfaces that, moving inward from the periphery of the main body, taper apart from each other toward the opposed outer surfaces of the main body, and a wear portion extending outward from the retention portion relative to the periphery of the main body, the wear portion being substantially planar and being configured to form an outer wear edge; and wherein the wear component further comprises a sacrificial portion that extends outward from the wear portion relative to the periphery of the main body, the sacrificial portion being coupled to the wear portion with a weakened portion therebetween, and being configured to be removed from the wear component at the weakened portion to form the wear edge.

* * * * *